US012371225B2

(12) United States Patent
Suokas et al.

(10) Patent No.: US 12,371,225 B2
(45) Date of Patent: Jul. 29, 2025

(54) STACKABLE PRODUCT PACKAGE AND METHOD OF MANUFACTURING THE SAME AS WELL AS PRODUCT PACKAGE BLANK

(71) Applicant: JOSPAK OY, Forssa (FI)

(72) Inventors: Jouni Suokas, Tammela (FI); Ari Lehikoinen, Helsinki (FI); Taneli Mero, Forssa (FI)

(73) Assignee: Jospak Oy, Forssa (FI)

( * ) Notice: Subject to any disclaimer, the term of this patent is extended or adjusted under 35 U.S.C. 154(b) by 341 days.

(21) Appl. No.: 16/763,364

(22) PCT Filed: Nov. 12, 2018

(86) PCT No.: PCT/FI2018/050831

§ 371 (c)(1),
(2) Date: May 12, 2020

(87) PCT Pub. No.: WO2019/092323

PCT Pub. Date: May 16, 2019

(65) Prior Publication Data

US 2020/0331660 A1 Oct. 22, 2020

(30) Foreign Application Priority Data

Nov. 13, 2017 (FI) ..... 20176011

(51) Int. Cl.
*B65D 21/02* (2006.01)
*B65D 5/20* (2006.01)

(52) U.S. Cl.
CPC ..... *B65D 21/0233* (2013.01); *B65D 5/2033* (2013.01); *B65D 5/209* (2013.01)

(58) Field of Classification Search
CPC .. B65D 21/0233; B65D 5/2033; B65D 5/209; B65D 21/0212; B65D 21/0215; B65D 21/0216
USPC ..... 206/503
See application file for complete search history.

(56) References Cited

U.S. PATENT DOCUMENTS 3,536,248 A 10/1970 Odenhagen et al.
3,756,495 A 9/1973 Bemiss
4,130,236 A * 12/1978 Manizza ..... B65D 5/246 229/114

(Continued)

FOREIGN PATENT DOCUMENTS

EP 1398276 3/2004
EP 2441696 4/2012

(Continued)

*Primary Examiner* — Andrew D Perreault
(74) *Attorney, Agent, or Firm* — Bauer & Joseph

(57) ABSTRACT

The invention relates to a stackable product package, a method of manufacturing the same and a product package blank. The stackable product package comprises a body part (2) provided with a bottom (3), and with walls (2*a*, 2*b*, 2*c*) in connection with the bottom (3), as well as with rim members (4*a*) folded outwards along folding lines (4*e*), at the top edge of the walls, and constituting a substantially planar rim portion (4), the body part (2) enclosing a receiving space for the product to be packed. At the lateral edges of each intermediate wall (2*c*) of the body part (1), and in proximity to a folding line (2*e*), bracket members (2*f*, 2*g*) are provided to keep the product packages (1), when nested, spaced apart.

9 Claims, 5 Drawing Sheets

(56) References Cited

U.S. PATENT DOCUMENTS

Figure 1:
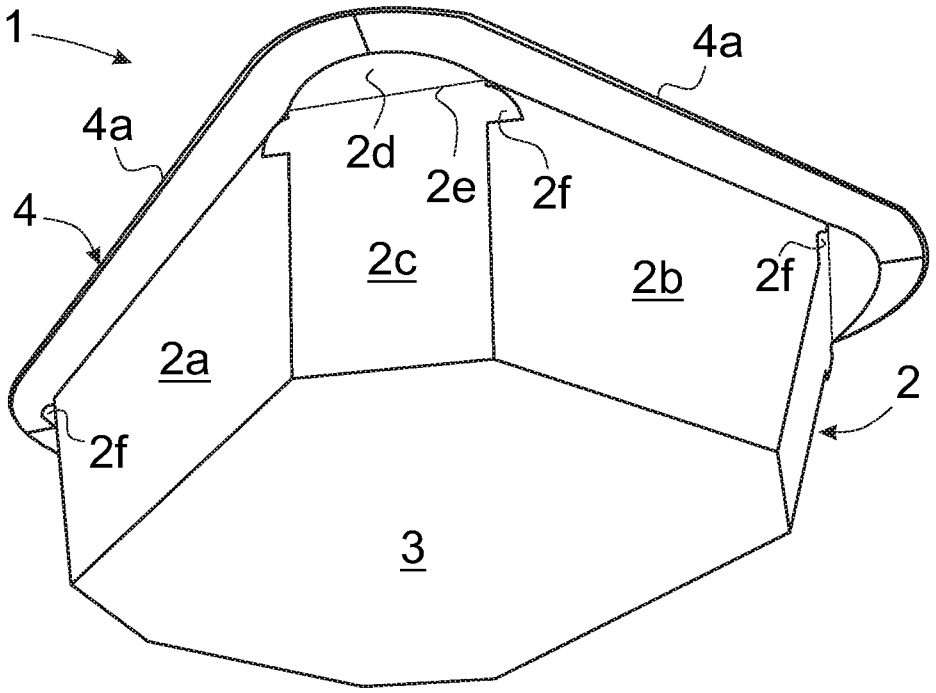

| | | | | |
|---|---|---|---|---|
| 4,714,164 | A | 12/1987 | Bachner | |
| 5,326,021 | A * | 7/1994 | Farrell | B65D 5/28 229/109 |
| 5,533,623 | A | 7/1996 | Fischer | |
| 2004/0226850 | A1 | 11/2004 | Behnke et al. | |
| 2006/0006215 | A1 | 1/2006 | Chen | |
| 2018/0022529 | A1 * | 1/2018 | Tye | B65D 7/26 206/557 |

FOREIGN PATENT DOCUMENTS

| | | | | |
|---|---|---|---|---|
| GB | 1296183 | | 11/1972 | |
| GB | 1314148 | | 4/1973 | |
| GB | 1579535 | | 11/1980 | |
| GB | 2146622 | | 4/1985 | |
| GB | 2306945 | A * | 5/1997 | B65D 5/2047 |
| WO | 2012/068208 | | 5/2012 | |
| WO | 2013/046592 | | 4/2013 | |

* cited by examiner

STACKABLE PRODUCT PACKAGE AND METHOD OF MANUFACTURING THE SAME AS WELL AS PRODUCT PACKAGE BLANK

The stackable product packages comprise bracket members intended for keeping the product packages, when nested within each other, spaced apart. Preferable material options for the stackable product package may include corrugated paperboard, cardboard or any other appropriate recyclable fiber material.

It is known that there are different kinds of foodstuff packages available, for packing, for example, ready meals which can be heated in a microwave oven or the like. Currently, a major part of these packages are entirely made of non-recyclable plastic. This is a huge environmental problem. Besides, the design includes a horizontal circumferential flange extending around the top edge of the entire package and intended as an attachment face and a seaming base for a package lid used to tightly close the package by heat-sealing once the package is filled and the food contained therein is cooked, if needed.

Foodstuff packages made of cardboard or the like, for example, and lined, on the inside, with a separate foodstuff foil, just like traditional plastic packages, are also known. A solution like this is disclosed in EP 2 441 696. The top edge of the cardboard-based foodstuff package described in this patent specification is provided, similarly to the above-described plastic package, with a substantially horizontal, laterally extending planar circumferential flange for attaching a lid. For space saving, it is preferable to store and keep the product package boxes, when finished, within and on top of each other in product package stacks. However, during storage and transport, jamming often occurs in the product package stack, possibly making it difficult to pick a single product package box out of the product package box stack. The product package boxes are automatically filled and the single product package box is picked out of the product package box by a machine. Any product package boxes jammed and attached against each other disturb the filling process, which, in turn, extends the product-batch manufacturing time and decreases the efficiency of the production process.

The known patent specification GB1314148 A discloses a solution wherein the end-walls of the container comprise lugs preventing these containers, when stacked, from jamming together. This solution does not comprise a planar rim portion consisting of the body material of the container and constituting an essential part of the current packages for ensuring their gas-tightness. In this solution, the rim portion is formed from an inner lining material overhanging the edges of the container. Therefore, this solution does not describe the essential feature how to create, above the lugs, a substantially planar rim portion from a single package blank, in a reliable and advantageous manner.

This invention aims at eliminating the above-mentioned drawbacks and providing an inexpensive, sturdy as well as space- and cost-effective stackable product package. It also aims at providing a stackable product package which, when stacked in a nested way, does not cause jamming in the stack, and which allows the product package stacks to be reliably utilized in a machine filling process of the product packages The stackable product package according to the invention comprises a body part provided with a bottom, and with walls in connection with the bottom, as well as with rim members folded outwards along folding lines, at the upper edge of the walls, and constituting a substantially planar rim portion, the body part enclosing a receiving space for the product to be packed. The body part comprises more than one bracket members to keep the packages, when nested, at a given distance from each other.

At least four bracket members, and preferably eight bracket members, are suitably provided at the edges of the intermediate walls of the frame part, at the end thereof facing the planar rim portion, in order to prevent the product packages from jamming together when stacked within each other for storage and transport. The bracket members serve to keep the nested product packages spaced apart. The distance from the support face of the bracket member to the lower face of the rim portion of the same product package suitably equals to, or is greater than, one millimeter and preferably 4 to 6 millimeters.

In the method of manufacturing the stackable product package according to the invention, a receiving space for the product to be packed, having a bottom and walls, and a body part for the receiving space, as well as a substantially planar rim portion formed from the rim members by folds, are created for the product package. At the lateral edges of each intermediate wall of the frame part, and in proximity to the folding line, bracket members are provided to keep the product packages, when nested, spaced apart.

According to a preferable solution, the bracket members of the body part of the product package are formed out of bracket member cutting patterns made in product package blanks.

According to another preferable solution, the bracket members of the body part of the product package are created, prior to applying an inner lining, by bending the bracket members, which are cut into the intermediate walls of the frame part, out from the surface plane of the walls.

The product package blank according to the invention comprises a sheet-like structure made of recyclable fiber material and having a bottom portion, wall portions and rim portions, separated by folding lines and cuts, for the bottom, walls and rim portions of a product package created from the product package blank by folding. The product package blank has bracket members provided at its intermediate walls.

An advantage of the solution according to invention is that the product package is made to be easily stackable in a nested way, without allowing jamming to occur in the product package stack, when complete, during storage and transport. An additional advantage thereof is that a single product package can easily be picked out of the product package stack. The above allows for a reliable machine filling process of the product packages, reducing both the number of fault situations in the filling process and the process lead time.

Still another advantage is that, by positioning the bracket members at the intermediate walls, the tray package can be provided with a simple, reliable and inexpensive planar rim portion because the intermediate walls do not comprise parts of the rim portion.

Still another advantage is that the product package with its bracket members and substantially planar rim portion is folded out of a single paperboard or cardboard blank, thus minimizing material overlapping and resulting in manufacturing material and cost savings.

Figure 2:
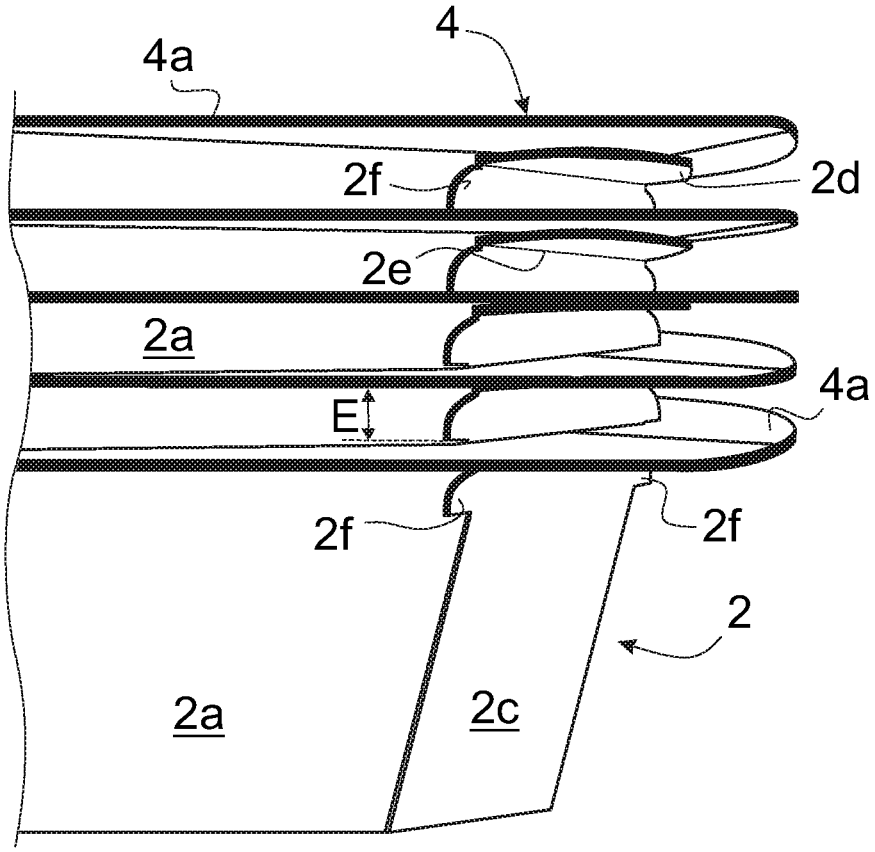
Figure 3:
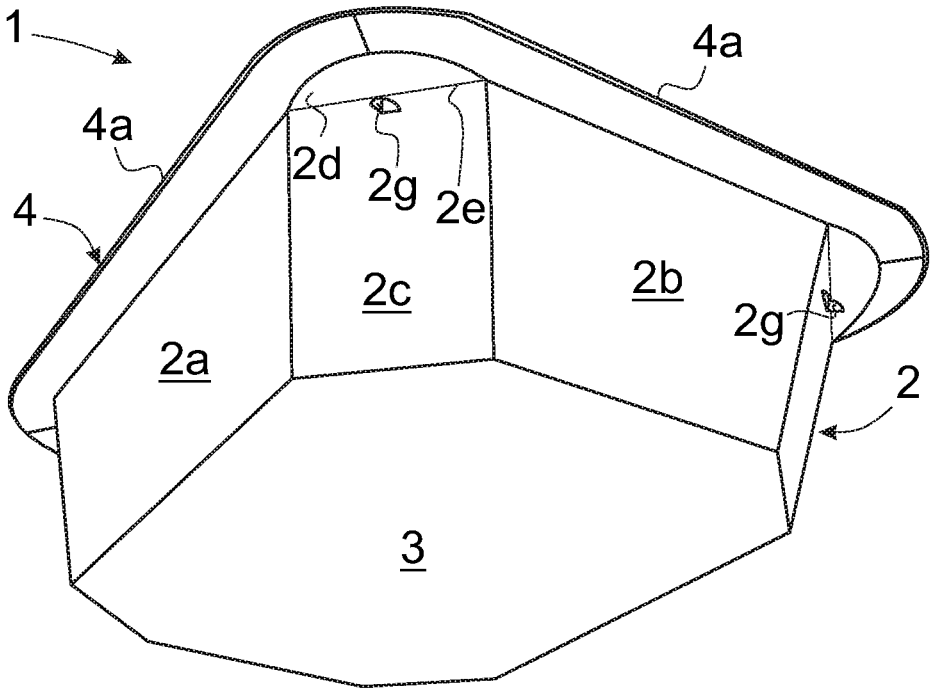
Figure 4:
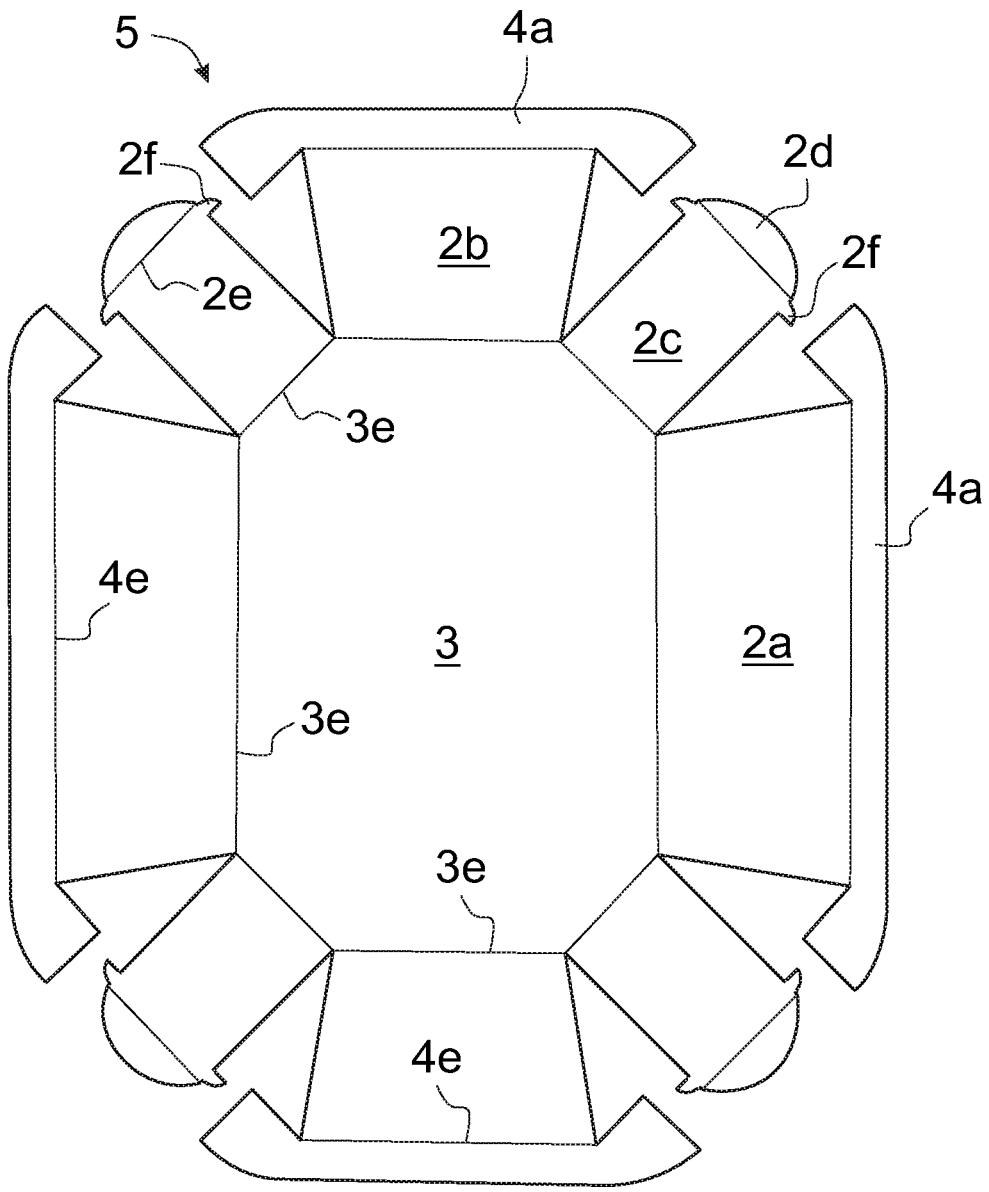
Figure 5:
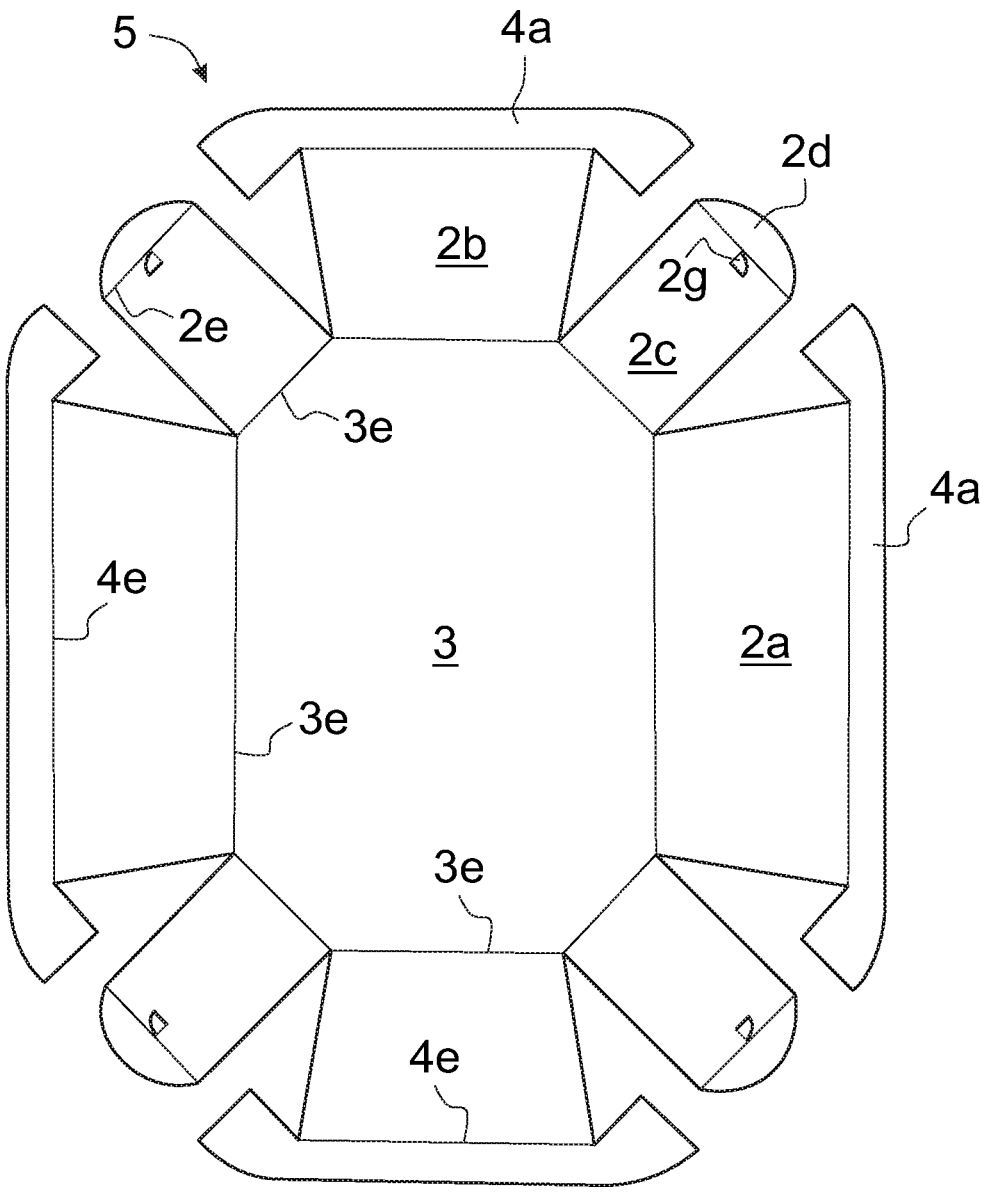

In the following, the invention will be explained in more detail, by means of exemplary embodiments, with reference to the accompanying drawings wherein FIG. 1 is an oblique lateral and bottom view of a stackable product package according to the invention, with brackets members at its intermediate walls, FIG. 2 is a lateral simplified and not-in-scale view of the product packages according to FIG. 1 stacked within and on top of each other, FIG. 3 is an oblique lateral and bottom view of a fourth stackable product package according to the invention, with the brackets members bent out from the intermediate walls, FIG. 4 is a top view of the product package according to the invention, in the form of an unfolded blank prior to folding it into a product package, FIG. 5 is a top view of the product package according to FIG. 3, in the form of an unfolded blank prior to folding it into a product package.

FIGS. 1 to 3 show two stackable product packages according to the invention 1 whose body part 2 consists of eight walls 2*a*, 2*b*, 2*c*.

FIG. 1 is an oblique and lateral view of a stackable product package 1 according to the invention, with bracket members 2*f* at its intermediate walls 2*c*. Preferably, the stackable product package 1 according to the invention is a foodstuff package, intended for a ready meal, for example. The product package 1 has a body part 2 and an optional inner lining. The body part 2, in turn, has a bottom 3, two lateral walls 2*a* and two end walls 2*b*, as well as intermediate walls 2*c* therebetween, in the corners of the product package 1, and, additionally, rim portions 4*a* extending laterally outwards from the upper edge of the lateral and end walls 2*a*, 2*b* and forming a substantially planar rim portion 4 of the product package 1. With this setup, the product package 1 has a receiving space, comprising the bottom 3 and the walls 2*a* to 2*c*, for the product to be packed, such as a food portion. The brackets members 2*f* are provided at the lateral edges of the intermediate walls, in proximity to a folding line 4*e*. Because the intermediate walls 2*c* of the body part each have their brackets members, the number of the bracket members 2*f* of product package 1 is eight in total.

The body part 2 is made of a suitable recyclable fiber material. Preferably, the material is corrugated paperboard, cardboard or any other appropriate recyclable fiber material. The body part 2 is formed by folding it out of a package blank 5 shown below in FIG. 6, by a machine, for example.

The lateral walls 2*a* and the end walls 2*b* of the body part 2 of the product package 1 have four components, i.e. the rim members 4*a*, of the planar rim portion 4 connected thereto, to be folded, by a machine, outwards from the lateral walls 2*a* and the end walls 2*b* along folding lines 4*e*, i.e. scored lines, made in the package blank in advance, and into a planar attachment face, i.e. the rim portion 4, for an optional inner lining and a lid foil. The rim members 4*a* of the rim portion 4 are connected by a butt joint at the corners of the product package 1, and, consequently, sealed joints are created at the corners of the rim portion 4. The intermediate walls 2*c* are created by folding them upwards at the scored lines 2*e* and by attaching a reinforcement member 2*d* below the corner of the rim portion 4, with the result that the bracket members 2*f* cut into the package blank 5 project from the body part 2 of the product package 1 below the rim portions 4. The planar shape of the rim portion 4 of the tray package is a critical feature for making the product package, when lidded, gastight, and therefore, it is essential that the bracket members 2*f*, 2*g* are not joined to the lateral walls or the end walls 2*a*, 2*b* to which the laterally extending rim portions 4*a* are joined.

FIG. 2 is a lateral, simplified and not-in-scale view of product packages 1 according to the invention, stacked within and on top of each other. The bracket members 2*f* project from the body part 2 of the product packages 1. The bracket members 2*f* of the upper product package 1 nested in the lower product package 1 are supported on the upper face of the rim members 4*a* of the planar rim portion 4 of the lower product package 1, distinctly spacing the rim members 4*a* of the lower product package 1 from the rim members 4*a* of the upper product package. The rim members 4*a* of the lower and upper the product packages are uniformly spaced over the entire planar rim portion 4 of the product packages. The distance E from the support face of the bracket member 2*f*, 2*g* to the lower face of the rim member 4*a* of the same product package suitably equals to, or is greater than, one millimeter, and preferably 4 to 6 millimeters.

FIG. 3 is an oblique lateral and bottom view of a second stackable product package 1 according to the invention, with the bracket members 2*g* bent out from the intermediate walls 2*c* of the body part 2. The body part 2 of the product package has four intermediate walls 2*c*, the bracket members 2*g* being provided centrally to the upper edge thereof, in proximity to the folding lines 2*e*, and keeping, as the product packages 1 are stacked on top of each other, the product packages 1 spaced apart in the stack. The bracket members 2*g* are formed out of cuts, made in the product package blank 6 and extending through the body part 2, by bending the bracket member 2*g*, thereat, out from the body part 2 along a folding line. In the setup process of the product package 1, the bracket member 2*g* must be bent out before any inner lining is applied on the product package 1.

FIG. 4 is a top view of the product package 1 according to FIG. 1, in the form of an unfolded blank prior to folding it into a product package 1. The product package blank 5 comprises a sheet-like structure, preferably made of recyclable fiber material, having a bottom portion, wall portions and rim portions separated by folding lines 3*e*, 4*e* and cuts, for the bottom 3, walls 2*a*, 2*b*, 2*c* and rim portions 4*a* of a product package 1 to be created from the product package blank 5 by folding. According to a preferable solution, the bottom portion is separated, along the folding lines 3*e*, from the wall portions forming the lateral walls 2*a* and the end walls 2*b*, as well as from the wall portions forming the intermediate walls 2*c*. In addition, the rim members 4*a* forming the rim portion of the product package 1 are separated, along the folding lines 4*e*, from the wall portions forming the lateral walls 2*a* and the end walls 2*b*. The intermediate walls 2*c* are situated between the ends of the lateral walls 2*a* and the end walls 2*b* and form part of the wall structure of the product package 1 when finished. Preferably, a reinforcement member 2*d*, separated by the folding line 2*e*, is provided in the free end of the wall portions forming the intermediate walls 2*c*. Here, "separating" does not refer to "detaching" but to making the folding lines 2*e*, 3*e*, 4*e*. The bracket members 2*f* are formed laterally to the intermediate walls 2*c*, in proximity to the folding lines 4*e*.

FIG. 5 is a top view of the product package 1 according to FIG. 3, in the form of an unfolded blank prior to folding it into a product package 1. The product package blank 6 comprises a sheet-like structure, preferably made of recyclable fiber material, having a bottom portion, wall portions and rim portions separated by folding lines 3*e*, 4*e* and cuts, for the bottom 3, walls 2*a*, 2*b*, 2*c* and rim portions 4*a* of a product package 1 to be created from the product package blank 5 by folding. According to a preferable solution, the bottom portion is separated, along the folding lines 3*e*, from the wall portions forming the lateral walls 2*a*, the end walls 2*b* and the intermediate walls 2*c*. In addition, the rim members 4*a* forming the rim portion of the product package 1 are separated, along the folding lines 4*e*, from the wall portions forming the lateral walls 2*a* and the end walls 2*b*. Cuts for creating the bracket members 2*g* are made in the intermediate walls 2*c*, centrally to the intermediate walls 2*c*, near the folding lines 2*e* of the reinforcement members 2*d*. In the uncut end of the bracket member 2*g*, folding lines for bending the bracket members 2*g* out from the body part 2 of the product package 1, are made. If an inner lining foil is applied on the product package, in the setup process of the package, the bracket members 2*g* must be bent out along the folding lines prior to the application of the inner lining foil.

In the above exemplary embodiments, the bracket members 2*f*, 2*g* serve to keep the product packages 1, when nested, spaced part. The distance E from the support face of the bracket member 2*f*, 2*g* to the lower face of the rim portion 4*a* of the same product package 1 suitably equals to, or is greater than, 1 millimeter, and preferably 4 to 6 millimeters.

The product packages 1, when stacked and suitably separated by at least four bracket members 2*f*, 2*g*, cannot get jammed together, but the rim portions 4*a* of each two stacked product packages 1 are clearly spaced apart, allowing for an easy and smooth filling process of the product packages. Positioning the bracket members 2*f*, 2*g* in the intermediate walls 2*c*, which have no rim member 4*a*, allows for an easy and smooth manufacturing process of the substantially planar rim portion 4.

It will be appreciated by a person skilled in the art that the invention is not solely restricted to the examples given above but may vary within the accompanying claims. Thus, some structural solutions may differ from the above. The bracket members may vary in shape, location or number, for example. The spacing between the stacked product packages may also differ from the above. As an example, two elongated bracket members provided in the intermediate walls of the product package are enough to keep the nested product packages spaced apart in the stack.

It will also be appreciated by the person skilled in the art that the stackable product packages may vary in shape from the above. The simplest and most common shape of the body part of the product package is a rectangle, for example. However, the package can have some other than a box-like rectangular shape. As an example, this shape can be polygonal, or also round or oval, depending on the folding lines of the finished blank. When the shape is not a quadrilateral, the number of the walls may also differ from the above, and, therefore, separate lateral or end walls may not exist, but two walls, which are curved, for example, and which have a required number of bracket members on their circumferences, in proximity to the rim portions, are provided. It is also possible to make the angle between the bottom and the walls, for example, less acute by an additional fold of the walls, near the bottom. Further, the shape can also be asymmetrical.

It will also be appreciated by the person skilled in the art that the stackable product packages may consist of some other material than recyclable fiber material. In this case, the body part of the product package can be made of any other foldable material, such as corrugated paperboard. The body part of the product package can be made of different grades of board, cardboard or paper, or, also of woven material, or a combination of different materials.

The invention claimed is:

1. A stackable product package (1), comprising a body part (2) provided with a bottom (3), and with walls (2*a*, 2*b*, 2*c*) in connection with the bottom (3), said walls including two lateral walls (2*a*) and two end walls (2*b*), as well as intermediate walls (2*c*) therebetween, in the corners of the stackable product package (1), said two lateral walls and two end walls being each provided with a rim member (4*a*) folded outwards along a rim member folding line (4*e*) at an upper edge of each of said two lateral walls (2*a*) and two end walls (2*b*), said rim members constituting a substantially planar rim portion (4), wherein a reinforcement member (2*d*), separated by a reinforcement member folding line (2*e*), is provided in a free end of a wall portion forming each intermediate wall, the body part (2) enclosing a receiving space for the product to be packed, characterized in that:

at lateral edges of each intermediate wall (2*c*) of the body part (2), and in proximity to the reinforcement member folding line (2*e*), bracket members (2*f*) are provided to keep such stackable product packages (1), if nested, spaced apart.

2. The stackable product package as defined in claim 1, characterized in that the body part (2) comprises at least four bracket members (2*f*).

3. The stackable product package as defined in claim 1, characterized in that, each bracket member comprises a supporting face such that, if such stackable product packages are stacked in a nested way, the support face of each bracket member (2*f*) of an upper product package (1) is supported on an upper face of the rim member (4*a*) of a lower product package (1).

4. The stackable product package as defined in claim 1, characterized in that a distance (E) from a support face of the bracket member (2*f*) to a lower face of the rim member (4*a*) of the same product package (1) equals to, or is greater than, one millimeter.

5. The stackable product package as defined in claim 1, characterized in that the material of the body part (2) is recyclable cardboard or corrugated paperboard.

6. The stackable product package as defined in claim 1, characterized in that the product package (1) is a foodstuff package.

7. The stackable product package as defined in claim 2, characterized in that the body part (2) comprises at least eight bracket members (2*f*).

8. The stackable product package as defined in claim 4, characterized in that the distance (E) from the support face of the bracket member (2*f*) to the lower face of the rim member (4*a*) of the same product package (1) equals to, or is greater than, 4 to 6 millimeters.

9. The stackable product package of claim 1, wherein an end portion of each rim member (4*a*) for each lateral and end wall abuts an end portion of the rim member of an adjacent lateral or end wall so as to form the substantially planar rim portion.

* * * * *